US010783763B2

(12) United States Patent
Sun

(10) Patent No.: US 10,783,763 B2
(45) Date of Patent: Sep. 22, 2020

(54) BIOLOGICAL SENSING PERIMETER AND USAGE METHOD THEREFOR

(71) Applicant: Jianhua Sun, Mianyang (CN)

(72) Inventor: Jianhua Sun, Mianyang (CN)

( * ) Notice: Subject to any disclaimer, the term of this patent is extended or adjusted under 35 U.S.C. 154(b) by 0 days.

(21) Appl. No.: 16/314,243

(22) PCT Filed: Jun. 22, 2017

(86) PCT No.: PCT/CN2017/089506
§ 371 (c)(1),
(2) Date: Dec. 28, 2018

(87) PCT Pub. No.: WO2018/001157
PCT Pub. Date: Jan. 4, 2018

(65) Prior Publication Data

US 2019/0206214 A1 Jul. 4, 2019

(30) Foreign Application Priority Data

Jun. 29, 2016 (CN) ..... 2016 1 0506976

(51) Int. Cl.
*G08B 13/24* (2006.01)
*G08B 5/36* (2006.01)
*G08B 13/12* (2006.01)

(52) U.S. Cl.
CPC ..... *G08B 13/2497* (2013.01); *G08B 5/36* (2013.01); *G08B 13/122* (2013.01); *G08B 13/24* (2013.01)

(58) Field of Classification Search
CPC ..... G08B 13/2491; G08B 13/2494; G08B 13/2497; G08B 13/26; H02J 50/60
USPC ..... 340/541
See application file for complete search history.

(56) References Cited

U.S. PATENT DOCUMENTS 3,293,631 A * 12/1966 Premack ..... G08B 13/26 340/552
4,064,499 A * 12/1977 Geiszler ..... G08B 13/2497 340/508
4,174,518 A * 11/1979 Mongeon ..... G08B 13/2497 323/280
4,213,122 A * 7/1980 Rotman ..... G08B 13/2497 340/552
4,346,373 A * 8/1982 Hassman ..... G08B 13/26 340/561
4,553,135 A * 11/1985 Grynberg ..... G08B 13/26 340/552

(Continued)

*Primary Examiner* — Emily C Terrell
(74) *Attorney, Agent, or Firm* — CBM Patent Consulting, LLC

(57) ABSTRACT

A biosensitive perimeter includes a support, an excitation wire, an induction wire, a lead wire, a pulse signal generator, a triode, a step-up transformer, a processor, and an alarm; wherein, said excitation wire and said induction wire pass through a plurality of supports in parallel, and said excitation wire is used to form an induced electric field, and said induction wire is located in said induced electric field to sense the change information of said induced electric field caused by the biological magnetic field of a human body, and to transmit the sensed information of the induced electric field to the processor that is used to receive the information of the induced electric field sensed by the induction wire, and to determine whether the alarm is required to be activated; and said excitation wire and said induction wire are arranged in parallel.

12 Claims, 2 Drawing Sheets

(56) References Cited

U.S. PATENT DOCUMENTS

| | | | | |
|---|---|---|---|---|
| 2005/0122223 | A1* | 6/2005 | Jones | G08B 13/2491 340/573.1 |
| 2005/0128090 | A1* | 6/2005 | Gerszberg | G08B 13/124 340/573.1 |
| 2019/0296589 | A1* | 9/2019 | Ardavan | H02J 7/025 |

* cited by examiner

BIOLOGICAL SENSING PERIMETER AND USAGE METHOD THEREFOR

This application is the U.S. national phase of International Application No. PCT/CN2017/089506 filed on 22 Jun. 2017 which designated the U.S. and claims priority to Chinese Application No. CN 01610506976.5 filed on 29 Jun. 2016, the entire contents of each of which are hereby incorporated by reference.

TECHNICAL FIELD

The present invention relates to the field of biosensor, and particularly relates to a biosensitive perimeter.

BACKGROUND ART

Biosensitive perimeter is relatively rare compared to other anti-theft sensor equipment in current domestic and foreign markets. Compared with other anti-theft devices, such as infrared sensors and other equipment, biosensitive perimeter has physical characteristics of generating an alarm signal by non-contact detection of the biological magnetic field of a human body, and also has advantages of high reliability, good security, and so on. For example, Chinese patent CN 01107018 disclosed an electronic anti-theft bar and making method thereof. The electronic anti-theft bar disclosed in this patent is a biologically sensed electronic anti-theft bar, while the kind of biosensor is susceptible to interference from the outside world, such as small animals, temperature, rainy weather, and other environmental interferences, which making the work voltage instability and causing an alarm by false trigger(s). In addition, there are working parameters to be manually commissioned, so that the construction speed is limited, such as the need to manually debug the operating frequency and alarm voltage, which is difficult to meet the need of stable and reliable wild environment, efficient construction, and convenient use.

For the reasons described above, the inventor has made in-depth studies on existing biosensitive perimeter to design a new biosensitive perimeter that can automatically adjust the operating parameters with automatic adaptation to the changes of the environment, and modify operating parameters through setting the auxiliary device, and meet the need of stable and reliable wild environments, convenient and efficient construction, and sense a human body non-contact and alarms.

CONTENTS OF THE INVENTION

In order to overcome the above problems, the inventor has made intensive studies to design a biosensitive perimeter, said perimeter includes a support, an excitation wire, an induction wire, a processor, and an alarm; wherein, said support 1 is more than one; and said excitation wire 2 and said induction wire 3 are arranged in parallel and are sequentially passed through a plurality of supports 1; and said excitation wire is used to form an induced electric field, and said induction wire is located in said induced electric field to sense said induced electric field and to transmit the sensed information of the induced electric field to the processor, and said processor is used to receive the information of the induced electric field sensed by the induction wire, and to determine whether or not the alarm is required to be activated according to the information. The biosensitive perimeter provided by the present invention can fully adapt to the indoor and outdoor environment, and adjust working parameters on its own, and has physical properties of generating an alarm signal by non-contact sensing of the biological magnetic field of a human body and eliminating wrong reports and missing reports caused by small animals, non-biological body, and natural climates, and the application scope and reliability of said biosensitive perimeter are improved, thereby completing the present invention.

Specifically, it is an object of the present invention to provide a biosensitive perimeter, wherein, said perimeter includes a support 1, an excitation wire 2, an induction wire 3, a processor 4, and an alarm 5.

Wherein, said support 1 is more than one; and said excitation wire 2 and said induction wire 3 are arranged in parallel and are sequentially passed through a plurality of supports 1; and said excitation wire 2 is used to form an induced electric field.

Said induction wire 3 is located in said induced electric field to sense said induced electric field and to transmit the sensed information of the induced electric field to the processor 4.

Said processor 4 is used to receive the information of the induced electric field sensed by the induction wire 3, and to determine whether or not the alarm 5 is required to be activated according to the information.

Wherein, said excitation wire 2 and said induction wire 3 are connected to the processor 4 respectively; and said processor 4 and said alarm 5 are disposed within said support 1.

Preferably, both said excitation wire 2 and said induction 25 wire 3 are telescopic.

Wherein, said induction wire 3 converts the sensed information of the induced electric field into a voltage signal, and transmits the voltage signal to said processor 4.

Said processor 4 is used to receive the voltage signal transmitted from the induction wire 3, and to control the operation of the alarm 5 when the voltage value of the voltage 5 signal is greater than the predetermined alarm voltage value.

Wherein, said processor 4 is also used to control the intensity of the induced electric field formed by said excitation wire 2 based on the received voltage signal in real time, thereby stabilizing the voltage value of the received voltage signal within the arming voltage range.

Wherein, said processor 4 includes a judgment module 41 and an adjustment module 42.

Said judgment module 41 stores a predetermined alarm voltage value, an arming voltage range, and an operating voltage value, and said operating voltage value falls within said arming voltage range.

When said judgment module 41 senses that the voltage value of said voltage signal is greater than the predetermined alarm voltage value, the alarm 5 is activated to issue audible and visual alarm signals.

When said judgment module 41 senses that the voltage value of said voltage signal falls within the arming voltage range, the adjustment module 42 is activated.

Said adjustment module 42 is used to control the intensity of the induced electric field formed by said excitation wire after activation, thereby making the voltage value of the voltage signal received by said processor 4 substantially equal to the operating voltage value.

Wherein, said operating voltage value is the information of the voltage value automatically recorded and stored by said biosensitive perimeter, and the recording process is:

When said biosensitive perimeter is energized and activated, said judgment module 41 receives the voltage signal transmitted from the induction wire 3, and determines whether or not the received voltage value of said voltage signal is within the arming voltage range, and when the voltage value of said voltage signal is within said arming voltage range and is substantially stable in the vicinity of a fixed voltage value for a predetermined period of time, the fixed voltage value is recorded as an operating voltage value.

Wherein, said predetermined alarm voltage value is greater than the maximum value in said arming voltage range.

Wherein, said perimeter also includes a power supply for supplying power to the excitation wire 2 and a filter for filtering the voltage signal transmitted from the induction wire.

Preferably, said perimeter also includes a pulse signal generator 6, a step-up transformer, a triode, and a lead wire.

Wherein, said alarm 5 includes a speaker 51 and an indicator light 52.

Said biosensitive perimeter is movable.

Advantageous effects of the present invention are as follows:

(1) The biosensitive perimeter provided according to the present invention can adjust the intensity of the induced electric field transmitted from the excitation wire according to the change of the external environment, thereby stabilizing the voltage signal generated by the induction wire within a small range, and reducing the bad interference on said perimeter by external environment.

(2) The biosensitive perimeter provided according to the present invention can distinguish between a human body and small animals by the difference of the sensed voltage value, thus eliminating wrong reports caused by small animals, and improving the reliability of the device.

(3) The biosensitive perimeter provided according to the present invention can form a virtual barrier of 360 degree space with the induced electric field generated by the excitation wire and the induction wire as the carrier, and the processor and the alarm convert the information generated by affection of human body on the induced electric field into the electric signal, thereby realizing non-contact detection or alarm.

(4) The biosensitive perimeter provided according to the present invention is movable, and the induction wire and the excitation wire thereon are also telescopic. The biosensitive perimeter is easy to move, and can be arranged in a variety of configurations, and is easy to use.

DESCRIPTION OF THE REFERENCE SIGNS

1—support
2—excitation wire
3—induction wire
4—processor
41—judgment module 15
42—adjustment module
5—alarm
51—speaker
52—indicator light
6—pulse signal generator
7—wire bushing
8—docking portion

SPECIFIC EMBODIMENTS FOR CARRYING OUT THE INVENTION

Hereinafter, the present invention will be explained in more detail with reference to figures and examples. Through these explanations, the features and advantages of the present invention will become clearer.

The term "exemplary" as used herein is intended to be "serving as an example, an illustrative embodiment, or an embodiment". Any of the embodiments described herein as "exemplary" need not be construed as preferred or better than other embodiments. Although various aspects of the embodiments are shown in the figures, it is not necessary to draw a figure in proportion unless otherwise specified.

Figure 1:
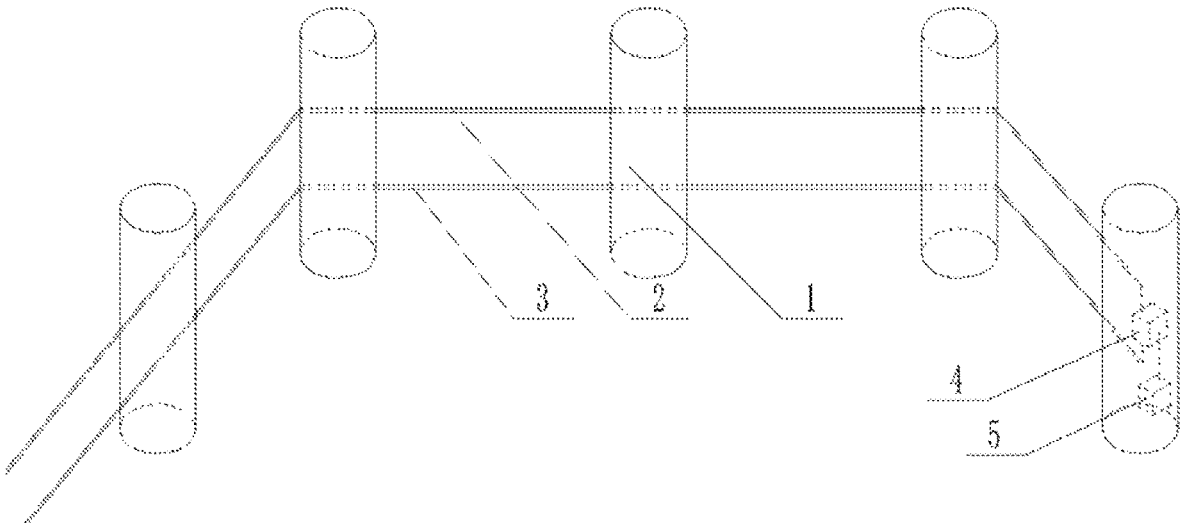
FIG. 1 shows a schematic view of the overall structure according to a preferred embodiment of the present invention.
Figure 2:
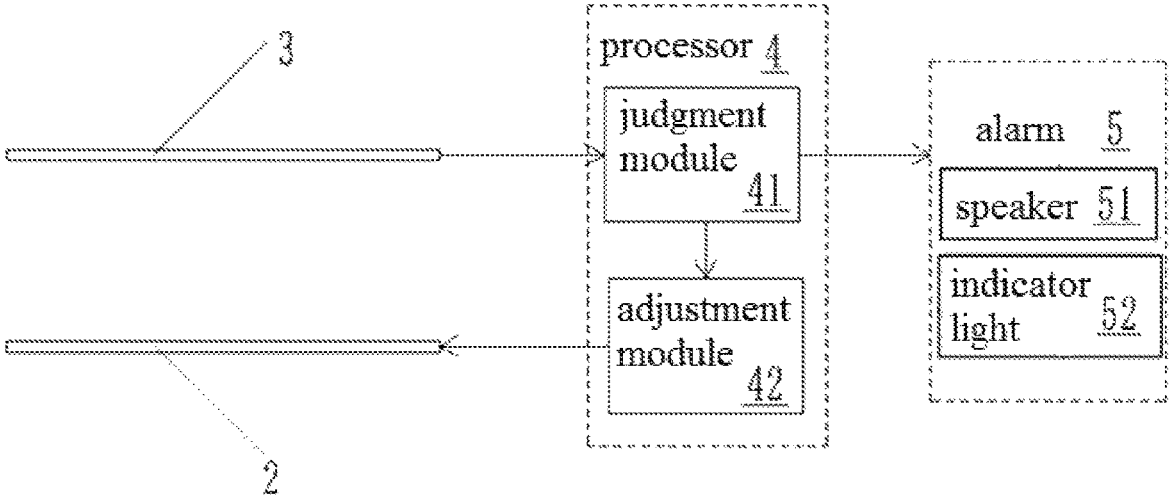
FIG. 2 shows a block diagram of the processor according to a preferred embodiment of the present invention.

According to the biosensitive perimeter provided by the present invention, as shown in FIG. 1 and FIG. 2, said perimeter includes a support 1, an excitation wire 2, an induction wire 3, a processor 4, and an alarm 5; wherein, said support 1 is more than one, and said processor 4 and said alarm 5 are preferably installed on the support 1, and further preferably, the inside of said perimeter has the space to accommodate the above mentioned processor 4 and alarm 5, so that only the perimeter can be seen from outside and the internal components can not be observed, thereby improving the aesthetic performance of the perimeter, and also makes it impossible to know that the perimeter has biometric anti-theft function from the appearance. If necessary, the biosensitive words can also be marked on the perimeter, which can be set according to the actual needs of users.

Preferably, the excitation wire 2 and the induction wire 3 are arranged in parallel and pass through a plurality of said supports. The distance between the adjacent two supports is adjustable, and the excitation wire 2 and the induction wire 3 therebetween may be arranged to be telescopic, that is, said excitation wire 2 and said induction wire 3 are each arranged in a roll-like shape usually in said support, and are stretched in a band-like shape or a line shape by an external force to constitute the mutually parallel excitation wire 2 and the induction wire 3, thereby making the application range of said perimeter more flexible, and the 5 transportation and the placement more convenient.

Preferably, said excitation wire 2 is used to form an induced electric field around it, the radiation range and radiation shape of the induced electric field are related to the shape of said excitation wire, preferably, the area of the induced electric field, 10 that is, the range of the induced electric field generated by the excitation wire is mainly an electric field centered on the excitation wire and radiated outward around its 360-degree direction, the electric field radiated outward in the 360-degree direction constitutes a virtual space barrier, and the extended area of the space barrier is also the guard range of the device provided by the present invention, that is, an organism entering the area will cause the change of the induced voltage value, and then the device will make response accordingly; the virtual space barrier described in the present invention covers at least the entire perimeter, and preferably comprises a predetermined area around the perimeter. The induced electric field described in the present invention is a very low frequency signal, that is, the induced electric field is a very low frequency induced electric field having an operating frequency of 3 to 30 kHz and having no adverse effect on the human body.

In a preferred embodiment, the support of said perimeter is movable and can be discharged at any point, such as a wall, a roadside and so on, according to a predetermined law, and can be set according to the specific needs.

In the present invention, there are a plurality of supports and at least two, and said supports can be increased according to the specific situation of the place of use. The maximum distance between each two supports is constant, which is determined by the length of the induction wire and the excitation wire between the adjacent supports.

In a preferred embodiment, said processor and said alarm are preferably placed within said support.

Figure 4:
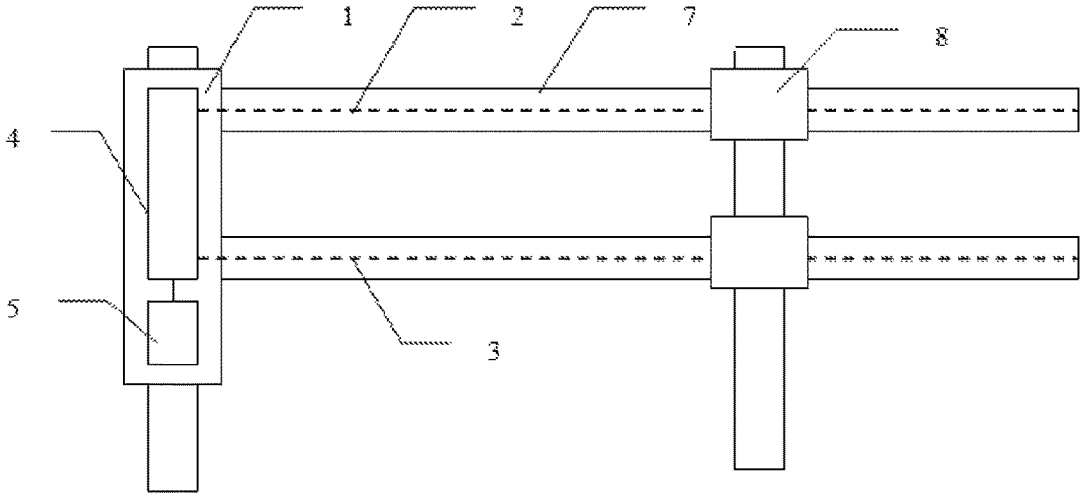
FIG. 4 shows a schematic view of the appearance of the support and the wire according to a preferred embodiment of the present invention.

In a preferred embodiment, as shown in FIG. 4, a wire bushing 7 is coated on the outside of said excitation wire and said induction wire, and said wire bushing is telescopic and can be telescoped with the extension of the wire. Between the two adjacent wire bushings there is provided a docking portion 8 for receiving the wire bushing.

Said induction wire and said excitation wire described in the present invention may be line-like wires or other shapes of conductors such as ribbon and so on.

In a preferred embodiment, said induction wire 3 is located in said induced electric field for sensing (or collecting) the information of said induced electric field, in particular the intensity information of said induced electric field, and converting the sensed information into a voltage signal and transmitting the voltage signal to said processor 4. In the present invention, the shape and the position of said induction wire are not particularly limited as long as they are located in the induced electric field and can sense the signal of the induced electric field. In the present invention, it is preferable that said excitation wire 2 and said induction wire 3 are arranged in parallel, and the relative position is not changed so as to make the intensity of the 5 induced electric field sensed by the induction wire 3 not easily changed, at least not due to the reason of the apparatus itself. Since an organism in nature can all produce very low frequency induced electric field (caused by flowing body fluid), when a human body enters the induced electric field generated by the 10 above-mentioned excitation wire, the induced electric field sensed by said induction wire 3 changes accordingly, and through the research and calculation of the changed induced electric field, it can detect whether there is any body has invaded or attempt to invade the induced electric field generated by the excitation wire, 15 so as to realize the biosensitive function.

Said processor 4 is used to receive the voltage signal transmitted from the induction wire 3, and to control the alarm operation when the voltage value of the voltage signal is greater than the predetermined alarm voltage value, that is the program of alarm activation.

Said alarm 5 is used to issue an audible and visual alarm signal under the control of the processor 4, the duration of the signal is 1 s to 10 s and can be set or mediated by the user in advance.

In a preferred embodiment, said processor 4 is also used to control the intensity of the induced electric field formed by the excitation wire based on the received voltage signal, thereby stabilizing the voltage value of the received voltage signal within the predetermined arming voltage range, that is, the processor 4 has the function of adjusting the intensity of the induced electric field rounded the excitation wire 2 in a manner of adjusting the power excitation voltage which generates the induced electric field. When the excitation voltage applied to the excitation wire increases, the intensity of the induced electric field is increased correspondingly, otherwise it is reduced.

The reason for setting up the processor having the above-mentioned function of adjusting the intensity of the induced electric field is that the biosensitive perimeter provided by the present invention will be used for a long period of time and often need to have a working life of several years or even decades, and the work site thereof may be outdoors, and the environment will inevitably change during the working period including changes in temperature, changes in air humidity, changes in lighting conditions, and so on, which may affect the intensity of the induced electric field around said excitation wire 2, and if the intensity interfered with external factors and largely changed, it is easy to give wrong reports and other undesirable phenomena.

Specifically, said processor 4 includes a judgment module 41 and an adjustment module 42.

Wherein, said judgment module 41 stores a predetermined alarm voltage value, an arming voltage range, and an operating voltage value, and said operating voltage value falls within said arming voltage range.

When said judgment module 41 senses that the voltage value of said voltage signal is greater than the predetermined alarm voltage value, the alarm is activated.

When said judgment module 41 senses that the voltage value of said voltage signal falls within the arming voltage range, the adjustment module 42 is activated.

Said alarm 5 can issue an alarm beep and an alarm indicator light after activation.

Said adjustment module 42 is used to control the intensity of the induced electric field formed by said excitation wire after activation in real time, thereby making the voltage value of the voltage signal received by said processor 4 substantially equal to the operating voltage value. The voltage value of the voltage signal received by the processor 4 is substantially constant under different external conditions by excluding the interference of the external conditions to the intensity of the induced electric field through said adjustment module 42. At this time, if the received voltage value changed abruptly and the changed voltage value exceeded said arming voltage range, the reason is basically that an organism enters into the induced electric field generated by the excitation wire, thereby making the induced electric field sensed by the induction wire change abruptly.

The arming voltage range described in the present invention is a numerical range having a certain voltage span. In the present invention, it is preferable that, in different external environments, in the case where there is no organism that can cause the alarm close to the alarm device (no organism that can cause the alarm enter the induced electric field formed by the excitation wire) that is, in the case where the alarm device is operating normally, the voltage value of the voltage signal transmitted from the induction wire 3 that can be received by the processor 4 falls within the arming voltage range. In the present invention, it is further preferable that, said different external environments include rain and snow weather, hot and humid hot weather, cold conditions, and so on commonly found in nature. That is, the voltage value received at this time is the result of the interaction between the induced electric field generated by the excitation wire and the induced electric field of the nature.

In a preferred embodiment, said predetermined alarm voltage value is greater than the maximum value in said arming voltage range, and the external environment which can only change the voltage value of the voltage signal transmitted from the induction wire 3 is impossible to raise the voltage value of the voltage signal to the predetermined alarm voltage value, that is, the natural environment can not trigger the alarm. Specifically, when the operation is performed under 85±2° C. for two hours or more, the voltage value of the voltage signal transmitted from the 20 induction wire 3 is smaller than the predetermined alarm voltage value and can not trigger the alarm; when the operation is performed under constant hot and humid (40±2) ° C. and RH (93±2) % for 48 hours or more, the voltage value of the voltage signal transmitted from the induction wire 3 is smaller than the predetermined alarm voltage value and can not trigger the alarm.

In a preferred embodiment, there is a predetermined difference between said predetermined alarm voltage value and the maximum value in said arming voltage range, which is used to distinguish whether the voltage change is a natural environment factor or an organism enters into the induced electric field. When an organism enters into the induced electric field generated by the excitation wire, the induced electric field sensed by the induction wire changes abruptly, and the voltage value of the voltage signal received by the processor 4 changes abruptly. If small animals less than 1 kg enter the induced electric field, the change amount of the induced electric field generated by the excitation wire will be small due to its small volume quality, so that the voltage value of the voltage signal received by the processor 4 will be also small, and the voltage value of the voltage signal received by the processor 4 at this time may exceed the arming voltage range, but must be smaller than the predetermined alarm voltage value and can not trigger the alarm.

In a preferred embodiment, said predetermined alarm voltage value is related to the voltage of the power supply section which generate the induced electric field on the excitation wire 2, and if the voltage of the power supply section is adjusted, said predetermined alarm voltage value will be adjusted accordingly; and said arming voltage range is 0 to 2 V, preferably 0.1 to 1.5 V, and more preferably 0.2 to 1 V.

In a further preferred embodiment, said predetermined alarm voltage value is 50% to 80% of the voltage value of the power supply section which generates the induced electric field on the excitation wire 2; said predetermined alarm voltage value is in the range of 2.5 to 24 V, preferably 3.5 to 10 V; and the voltage of the power supply section for generating the induced electric field on said excitation wire 2 is generally a safety voltage, the preferable voltage value is 5 to 30 V, and when the voltage of the power supply section for generating the induced electric field on said excitation wire 2 is 12 V, said predetermined alarm voltage value is 6 to 9 V, preferably 6 V.

In a preferred embodiment, said predetermined alarm voltage value and said arming voltage range described in the present invention are capable of being adjusted in accordance with a preset procedure under the control of the processor, or artificially set/changed through an external auxiliary device.

In a preferred embodiment, an operating voltage value is the voltage value information automatically recorded and stored by said biosensitive perimeter, and the recording process is: when said biosensitive perimeter is energized and activated, said judgment module 41 receives the voltage signal transmitted from the induction wire 3, and determines whether or not the received voltage value of said voltage signal is within the arming voltage range, and when the voltage value of said voltage signal is within said arming voltage range and is substantially stable in the vicinity of a fixed voltage value for a predetermined period of time, the fixed voltage value is recorded as an operating voltage value. The process described above is also referred to as an arming process, which is initiated at each power-up start with a start-up time of less than 10 seconds, that is, said biosensitive perimeter can enter normal alert state within 10 seconds of starting. If the voltage value received at the time of power-up is within said arming voltage range, the biosensitive perimeter will work normally and, if the voltage value is not within this range, an alarm signal will be issued until the received voltage signal is within said arming voltage range, and there may be a device failure or an organism in the area of the induced electric field at this time.

The area of the induced electric field described in the present invention, that is, the range of the induced electric field generated by the excitation wire, preferably is an electric field centered on the excitation wire and radiated outward around its 360-degree direction, and the electric field radiated outward in the 360-degree direction constitutes a virtual space barrier, and the extended area of the space barrier is also the guard range of the device provided by the present invention, that is, an organism 15 entering the area will cause the change of the induced voltage value and then make appropriate response.

In a preferred embodiment, said processor 4 includes a timing module, which is used for timing when the voltage value of the received voltage signal is greater than or equals to the predetermined alarm voltage value, and recording the duration of the voltage value, and at this point, the alarm is not activated. If the duration of the voltage (which is greater than the predetermined alarm voltage) is greater than 0 to 5 seconds, preferably 1 to 2 seconds, most preferably 1 second in the present invention, the alarm will be activated, and then an alarm signal will be issued.

In a preferred embodiment, said perimeter also includes a power supply, a filter, a voltage amplifier, and a pulse signal generator 6. Said power supply is preferably a DC power supply, and can be a battery; and said filter is used to filter the voltage signal transmitted from the induction wire, that is filtering out clutter in space to avoid interference. Furthermore, one or more of a high voltage generator, a power amplifying circuit, a transformer, and an inverter are further provided in said perimeter, wherein, said high voltage generator includes an oscillator and a triode.

Figure 3:
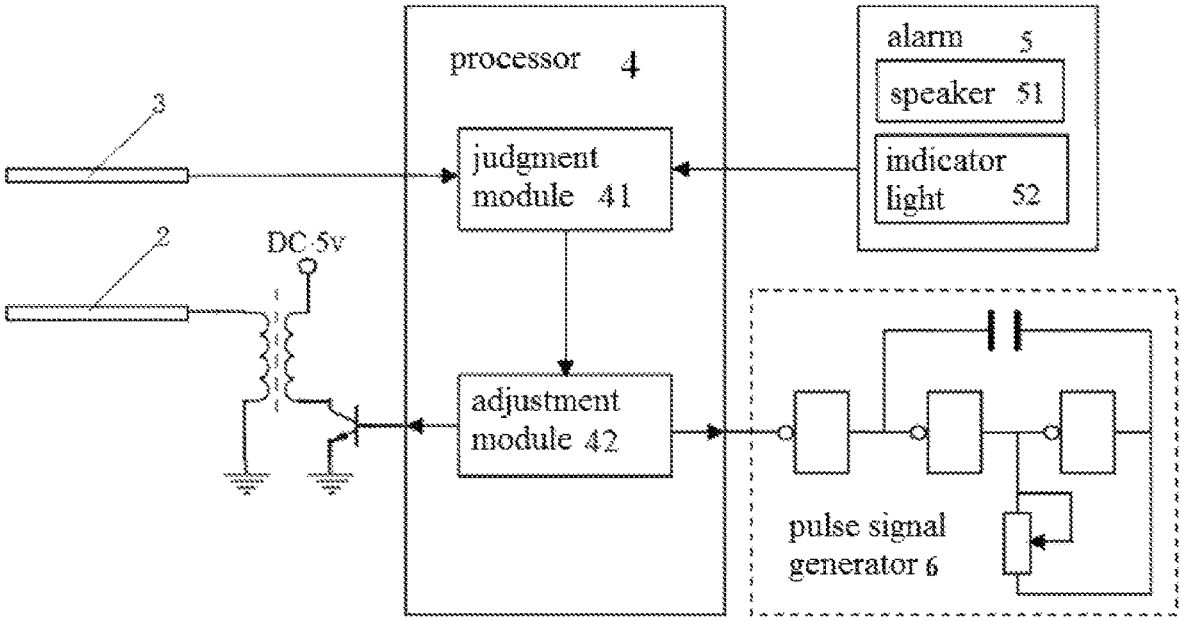
FIG. 3 shows a circuit diagram of the biosensitive perimeter according to a preferred embodiment of the present invention.

The preferred circuit configuration of the biosensitive perimeter provided in the present invention is shown in FIG. 3, wherein, said perimeter includes an excitation wire 2, an induction wire 3, a processor 4, an alarm 5, a pulse signal generator 6, and a voltage amplifier, wherein, the voltage amplifier includes a triode, a step-up transformer, a lead wire, and so on, wherein, it is preferable that the components described above are connected by a lead wire respectively.

In a preferred embodiment, the adjustment module and the judgment module in said processor are both microcontrollers, and may be an integrated microcontroller or a combination of a plurality of microcontrollers, preferably, both (of the adjustment module and the judgment module) are provided as embedded microcontrollers.

In a preferred embodiment, said processor 4 is also optionally provided with an access port for an external device, which may be an external input device for inputting initial data thereto.

In a preferred embodiment, said alarm 5 includes a speaker 51 and an indicator light 52. Said speaker can issue an alarm sound like "didi", and also can issue pre-stored language information to meet the requirement of "voice alarm" in various 5 applications.

In a preferred embodiment, said perimeter is further provided with a camera, and said alarm 5 further comprises a remote alarm department. The biosensitive perimeter can control the alarm to issue remote alarm information when there is a biological invasion, and said camera can photograph images near the perimeter and generate screen information. When said alarm 5 issues the remote alarm information, the camera also transmits the screen information captured at that time.

Preferably, said camera may be one or more, which can be set according to specific circumstances. Said camera may work in real time and store therein screen information of a predetermined length of time, or transfer the recorded screen information in real time to a predetermined memory for call at any time. Said camera may also work in a standby state, when necessary, such as issue of alarm information or receipt of instructions, it starts rapidly to obtain and send out the screen information.

Preferably, said perimeter further includes an information receiving end for receiving said remote alarm information and said screen information. Said information receiving end may be a computer processor or a mobile terminal such as a mobile phone and so on, and may be set according to the use environment and the application condition of the device.

It is further preferred that said information receiving end is also used to remotely control said camera and obtain the screen information, that is, said information receiving end can simultaneously receive the screen information in the vicinity of the perimeter when the alarm information is received, and when send instruction to the camera at any time, the information receiving end can receive the screen information in the vicinity of the perimeter at this time, so as to enhance the perimeter security feature more intelligent, but also to improve its stability.

A biosensitive regulation method, a biosensitive control method, a biosensitive alarm method of the biosensitive perimeter or a method for using the biosensitive perimeter is provided according to the present invention. In this method, firstly energize said biosensitive perimeter, and the excitation wire forms an induced electric field around it, and the induction wire converts the sensed signal of the induced electric field into a voltage signal and transmits to the judgment module of the processor; and this process is the activation of the perimeter.

Said judgment module receives the voltage signal transmitted from the induction wire, and determines whether or not the voltage value of said received voltage signal is within the arming voltage range, when the voltage value of said voltage signal is within said arming voltage range and is substantially stable in the vicinity of a fixed voltage value for a predetermined period of time, the fixed voltage value will be recorded as an operating voltage value; this process is the arming of the perimeter, and generally takes less than 10 seconds.

Said processor continues to receive the voltage signal transmitted from the induction wire in real time and determines whether the voltage signal is within the arming voltage range, and if the (voltage) signal is within the arming voltage range, the received voltage signal will be adjusted by controlling the excitation wire to make the voltage value substantially equal to the operating voltage value; if the signal value is greater than the predetermined alarm voltage value, it will be determined that someone intrude, and control the operation of the alarm, issue audible and visual alarm signals; if the signal value is not greater than said predetermined alarm voltage value and not in said arming voltage range, it will be determined mistakenly touched by small animals and will not be processed.

The present invention has been described above in detail by combing the preferred embodiments; however, these embodiments are exemplary and only serve as illustrative. On the basis of the present invention, various replacements and improvements are permitted, and will be seen in the scope of the present invention.

What is claimed is:

1. A biosensitive perimeter, characterized in that, said perimeter includes supports (1), an excitation wire (2), an induction wire (3), a processor (4), a pulse signal generator (6) and an alarm (5);

wherein, said excitation wire (2) and said induction wire (3) are arranged in parallel and are sequentially passed through supports (1); and said excitation wire (2) is used to form an induced electric field; and said induction wire (3) is located in said induced electric field to sense said induced electric field and to transmit the sensed information of the induced electric field to the processor (4); said excitation wire (2), said induction wire (3) and said pulse signal generator (6) are connected to the processor (4), respectively; wherein a voltage of power supply on said excitation wire (2) is 5 to 30 V, the induced electric field having an operating frequency of 3 to 30 kHz;

wherein said processor (4) includes a judgment module (41) and an adjustment module (42), said judgment module (41) stores a predetermined alarm voltage value, an arming voltage range and an operating voltage value, and said operating voltage value falls within said arming voltage range; said processor (4) adjusts intensity of the induced electric field generated by the excitation wire (2) in real time, and makes the operating voltage value as the same as a voltage value of a voltage signal that is received by the processor (4) when a changing value of the intensity of the induced electric field is over a threshold by the entrance of an organism into the induced electric field, the voltage of the voltage signal determines an activation of alarm system.

2. The biosensitive perimeter according to claim 1, characterized in that, said processor (4) and said alarm (5) are disposed within said supports (1); and said excitation wire (2) and said induction wire (3) are telescopic.

3. The biosensitive perimeter according to claim 1, characterized in that, said induction wire (3) converts the sensed information of the induced electric field into the voltage signal, and transmits said voltage signal to said processor (4), and said processor (4) is used to receive the information of the induced electric field sensed by the induction wire (3), and to determine whether or not the alarm (5) is required to be activated according to the information.

4. The biosensitive perimeter according to claim 1, characterized in that, when said judgment module (41) senses that the voltage value of said voltage signal is greater than the predetermined alarm voltage value, the alarm (5) is activated to issue audible and visual alarm signals, and when said judgment module (41) senses that the voltage value of said voltage signal falls within the arming voltage range, the adjustment module (42) is activated, and said adjustment module (42) is used to control the intensity of the induced electric field formed by said excitation wire after activation, thereby making the voltage value of the voltage signal received by said processor (4)

substantially equal to the operating voltage value; the predetermined alarm voltage value is 2.5-24 V, and the arming voltage range is 0-2 V.

5. The biosensitive perimeter according to claim 4, characterized in that, said operating voltage value is the voltage value information automatically recorded and stored by said biosensitive perimeter, and the recording process is:

when said biosensitive perimeter is energized and activated, said judgment module (41) receives the voltage signal transmitted from the induction wire (3), and determines whether or not the received voltage value of said voltage signal is within the arming voltage range, and when the voltage value of said voltage signal is within said arming voltage range and is substantially stable in the vicinity of a fixed voltage value for a predetermined period of time, the fixed voltage value is recorded as an operating voltage value.

6. The biosensitive perimeter according to claim 4, characterized in that, said predetermined alarm voltage value is greater than the maximum value in said arming voltage range.

7. The biosensitive perimeter according to claim 3, characterized in that, said perimeter further comprises a power supply for supplying power to the excitation wire (2) and a filter for filtering the voltage signal transmitted from the induction wire.

8. The biosensitive perimeter according to claim 1, characterized in that, said alarm (5) includes a speaker (51), an indicator light (52) and a remote alarm department.

9. The biosensitive perimeter according to claim 1, characterized in that, said biosensitive perimeter is movable.

10. The biosensitive perimeter according to claim 3, characterized in that, said processor (4) is used to receive the voltage signal transmitted from the induction wire (3) and to control the operation of the alarm (5) when the voltage value of the voltage signal is greater than the predetermined alarm voltage value.

11. The biosensitive perimeter according to claim 7, characterized in that, said perimeter further comprises a voltage amplifier that includes a step-up transformer, a triode, and a lead wire; the voltage amplifier is connected to pulse signal generator.

12. The biosensitive perimeter according to claim 8, characterized in that, said perimeter is further provided with a camera and an information receiving end.

* * * * *